United States Patent [19]

Dutcher

[11] Patent Number: 4,538,759

[45] Date of Patent: Sep. 3, 1985

[54] CAN CARTON WITH THREE PLY HANDLE STRUCTURE

[75] Inventor: Daniel P. Dutcher, Blaine, Minn.

[73] Assignee: Champion International Corporation, Stamford, Conn.

[21] Appl. No.: 695,741

[22] Filed: Jan. 28, 1985

Related U.S. Application Data

[63] Continuation of Ser. No. 528,511, Sep. 1, 1983, abandoned.

[51] Int. Cl.[3] ..... B65D 5/46

[52] U.S. Cl. ..... 229/52 B; 206/427; 229/40

[56] References Cited

U.S. PATENT DOCUMENTS

| | | | |
|---|---|---|---|
| 1,799,657 | 4/1931 | Tinsley | 229/52 BC |
| 2,308,050 | 1/1943 | Burr | 229/52 B |
| 2,402,219 | 6/1946 | Wesselman | 229/52 BC |
| 2,481,871 | 9/1949 | Potts | 229/52 B |
| 2,681,143 | 6/1954 | Guyer | 229/52 B X |
| 3,994,432 | 11/1976 | Kirby, Jr. | 206/427 X |

*Primary Examiner*—William I. Price
*Assistant Examiner*—Gary E. Elkins
*Attorney, Agent, or Firm*—Evelyn M. Sommer; William W. Jones

[57] ABSTRACT

The carton is formed from a cut and scored one piece paperboard blank and includes a simplified yet sturdy three ply handle structure. The handle is formed on the top panel of the carton, which top panel includes overlapping flaps which are adhesively secured together. The topmost flap has an opening cut therein to form a hand grip. The underlying flap has a terminal end portion which is folded back into the carton and adhered to the inside surface of the underlying flap to form a beaded fold at the free end of the underlying flap. The underlying flap extends beneath the topmost flap to an extent whereby the beaded fold lies within the confines of the hand grip opening. The portion of the top panel inwardly of the hand grip opening is three ply in thickness and the beaded fold line at the inner edge of the hand grip opening provides comfort when the carton is carried.

3 Claims, 6 Drawing Figures

CAN CARTON WITH THREE PLY HANDLE STRUCTURE

This application is a continuation of application Ser. No. 528,511, filed Sept. 1, 1983, now abandoned.

This invention relates to a simplified yet sturdy and comfortable hand grip for a twelve or twenty-four beverage can carton. The hand grip is three paperboard plies thick and has an underlying beaded fold edge to prevent the paperboard from cutting one's hand when the carton is carried.

Paperboard cartons for carrying a plurality of beverage cans, for example, twelve or twenty-four cans, are known in the prior art. The cartons are generally completely closed at the point of purchase and usually include some sort of dispensing means whereby the beverage cans can be removed one at a time. The cartons usually include a carrying feature, which may be a strap handle or may include openings cut into one of the carton panels to form a hand grip.

Since the filled cartons are relatively heavy, the hand grips are preferably of multiple ply thickness to provide added strength. The hand grips have been formed as openings cut in overlapping flaps forming a top panel for the carton, which overlapping flaps have back folded terminal portions which overlie each other and provide the multiple plies of material. Hand grip openings are cut in the overlapping flaps and may or may not include tabs which form the openings when they are pushed back into the carton. Patents which disclose typical examples of such hand grips are U.S. Pat. Nos. 3,540,581 Koolnis, issued Nov. 17, 1970; 3,696,990 Dewhurst, issued Oct. 10, 1972; 3,894,681 Arneson, issued July 15, 1975; and 4,216,861 Oliff, issued Aug. 12, 1980. Such prior art hand grip structures have generally been relatively complicated in construction and have generally utilized more paperboard than necessary to perform their desired function.

The hand grip of this invention possesses completely adequate strength and integrity and, yet, is of utmost simplicity in construction. The carton of this invention is formed with side, bottom and end walls and with a top wall, which is formed by overlapping top flaps or panels. The top wall panels are foldably connected to top edges of the side walls, and at least the topmost top wall panel has a hand grip opening cut therein. The underlying top wall panel has a terminal portion which is folded under and back and is adhesively secured to the inner surface of the underlying top wall panel. Thus, a bead fold is formed at the effective free edge of the underlying top wall panel, and a major portion of the underlying top wall panel is two ply in construction due to the folded back terminal portion. When the two top wall panels are lapped with each other, the bead fold is positioned within the confines of the hand grip opening so that the hand grip opening is provided with a rounded blunt finger gripping edge which will not irritate the fingers when the filled carton is carried. The two plies of the back folded underlying top wall panel and the one ply of the lapped topmost top wall panel are adhesively secured together and combine to form a three ply weight bearing portion inwardly adjacent to the hand grip opening, under which the fingers will extend when the carton is carried. If so desired, a second hand grip opening can be cut in the underlying top wall panel adjacent to the free edge of the folded back portion, and the second hand grip opening can be provided with a fold under tab.

It is, therefore, an object of this invention to provide a paperboard carton for carrying a plurality of beverage cans, which carton has a suitable hand grip structure formed in its top wall.

It is a further object of this invention to provide a carton of the character described wherein the hand grip structure is of utmost simplicity in construction.

It is yet another object of this invention to provide a carton of the character described wherein the hand grip structure includes a three ply weight bearing portion.

These and other objects and advantages of the carton of this invention will become more readily apparent from the following detailed description of a preferred embodiment thereof taken in conjunction with the accompanying drawings, in which.

Figure 1:
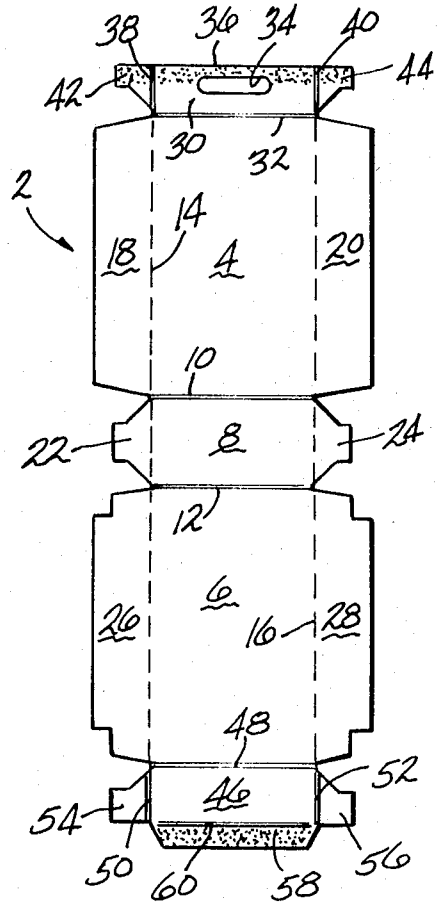
FIG. 1 is a plan view of a cut and scored blank of paperboard material adapted to be erected into a carton according to this invention.

Referring now to the drawings, there is shown in FIG. 1 a preferred embodiment of a cut and scored blank of paperboard material which is adapted to be erected into a carton formed in accordance with this invention. The blank 2 includes side walls 4 and 6 having an intervening bottom wall 8 disposed therebetween. The bottom wall 8 is foldably connected to the side wall 4 by a fold line 10 and to the side wall 6 by a fold line 12. Fold lines 14 and 16 extend across side walls 4 and 6 and bottom wall 8 to delineate side end wall panels 18 and 20 flanking side wall 4, bottom end wall panels 22 and 24 flanking bottom wall 8, and side end wall panels 26 and 28 flanking side wall 6. An outer top wall panel 30 is foldably connected to side wall 4 by a fold line 32. A hand grip opening 34 is cut in a medial portion of the outer top wall panel 30 and spaced inwardly from the free edge 36 thereof. A pair of fold lines 38 and 40 delineate outer top end wall panels 42 and 44. An inner top end wall panel 46 is foldably connected to side wall 6 along fold line 48. A pair of fold lines 50 and 52 delineate inner top end wall panels 54 and 56. A reinforcement flap 58 is foldably connected to the central edge of the inner top wall panel 46 along fold line 60. The reinforcement flap 58 and a portion of the outer top wall panel 30 are coated with adhesive as shown by the stippling in FIG. 1.

Figure 2:
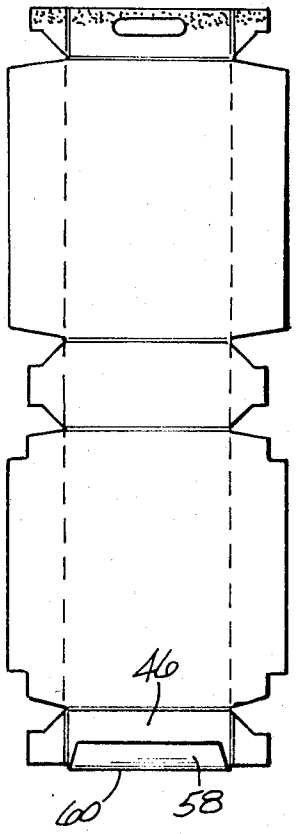
FIG. 2 is a plan view of the blank of FIG. 1 showing the first folding step performed in transforming the blank to a partially erected flat bulk shipping form of the carton.
Figure 3:
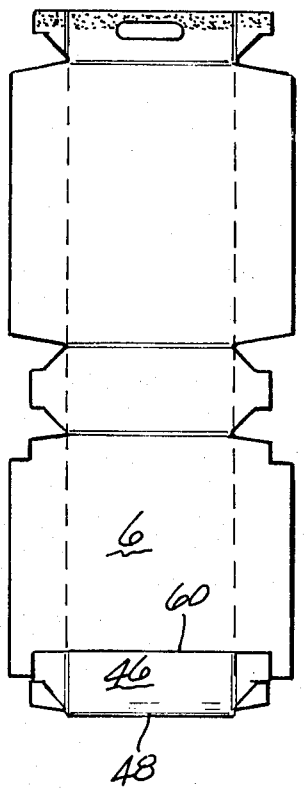
FIG. 3 is a plan view of the blank of FIG. 2 showing the second folding step in the erecting sequence.
Figure 4:
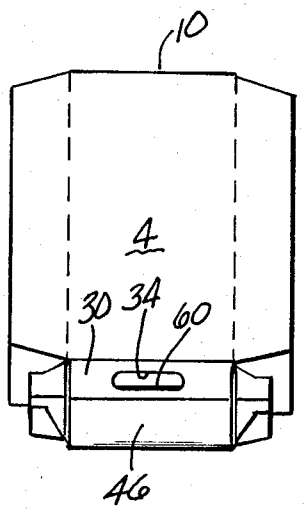
FIG. 4 is a plan view of the partially erected flat bulk shipping form of the carton resulting from the third folding step in the erecting sequence.

To initiate formation of the flattened bulk shipping configuration of the carton, the reinforcement flap 58 is folded about fold line 60 and adhesively secured to the inner surface of the inner top wall panel 46 as shown in FIG. 2. The inner top wall panel 46 is then folded about the fold line 48 into face-to-face contact with the side wall 6, as shown in FIG. 3, so that the fold line 60 overlies the side wall 6. The side wall 4 is then folded about the fold line 10 to bring the outer top wall panel 30 into overlying relationship with the inner top wall panel 46 whereupon the outer panel 30 is adhered to the inner panel 46. The extent of overlap of the panels 30 and 46 is such that the fold line 60 lies beneath but within the periphery of the hand grip opening 34. The fold line 60 thus gives the medial inner edge of the hand grip opening 34 a blunt, smooth contour which does not irritate the fingers when the filled carton is carried.

Figure 5:
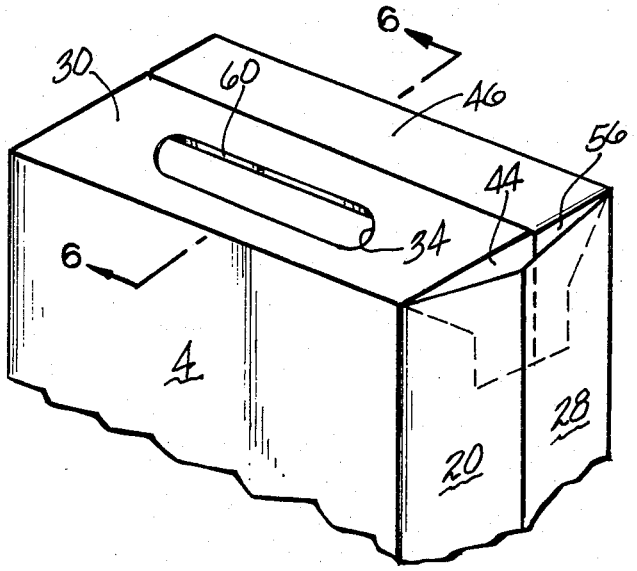
FIG. 5 is a fragmented perspective view of the top wall portion of the erected carton showing the hand grip portion thereof.

Referring now to FIG. 5, there is shown in perspective the top wall portion of the erected carton. It will be noted that the top end wall panels 44 and 56 are overlapped and adhesively secured together. Additionally, the side end wall panels 20 and 28 are overlapped and adhesively secured together and also overlap and are adhesively secured to the top end wall panels 44 and 56. This forms secure and sturdy top corners for the carton. The accessible positioning of the fold line 60 is also highlighted in FIG. 5.

Figure 6:
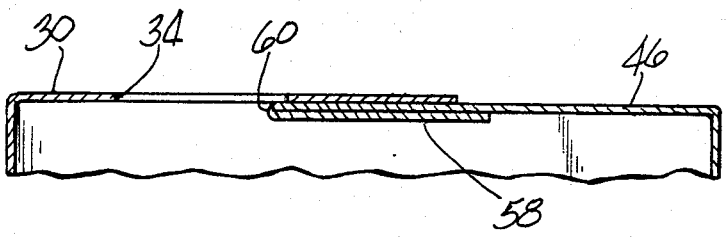
FIG. 6 is a sectional view of the carton taken along line 6—6 of FIG. 5.

FIG. 6 shows how the reinforcement panel 58 is folded beneath and secured to the inner top wall panel 46, shows the extent of overlap of the panels 30 and 46 and shows the manner in which the fold line 60 extends past the edge of the hand grip opening 34.

It will be readily appreciated that the carton of this invention is of simple construction and provides suitable strength needed to carry the relatively heavy beverage cans in twelve and twenty-four count quantities. The carton has a handle construction which is preferably one-sided to gain additional strength in the handle area and which has a smooth rounded edge which will not irritate one's fingers under extensive weight. The carton also is provided with overlapping top wall panels which form the handle area and with a lapped top end corner construction which provides improved strength.

Since many changes and variations of the disclosed embodiment of the invention may be made without departing from the inventive concept, it is not intended to limit the invention otherwise than as required by the appended claims.

What is claimed is:

1. A paperboard carton for carrying a plurality of beverage cans, said carton comprising:

(a) a bottom wall;

(b) a pair of side walls foldably connected to opposite side edges of said bottom wall;

(c) an outer top wall panel foldably connected to a top edge of one of said side walls;

(d) an inner top wall panel foldably connected to a top edge of the other of said side walls, said inner top wall panel having a reinforcement flap connected to an edge of said inner top wall panel along a fold line, said reinforcement flap being folded along said fold line and adhesively secured to an inner surface of said inner top wall panel;

(e) a hand grip opening formed in said outer top wall panel and spaced apart from an inner edge of said outer top wall panel; and (f) said inner and outer top wall panels being overlapped and adhesively secured together to form a top wall of said carton, said fold line on said inner top wall panel being disposed inwardly adjacent to an inner edge of said hand grip opening and within the perimeter of said hand grip opening, and said fold line extending in two directions beyond the edges of said hand grip opening and being devoid of cuts so as to be continuous and uninterrupted to form a blunt edge on said hand grip opening providing finger comfort when the carton is filled and lifted via said hand grip opening, the portion of said top wall between said inner edge of said hand grip opening and said inner edge of said outer top wall panel consisting of three plies of paperboard material.

2. The carton of claim 1 wherein said inner top wall panel is continuous and uninterrupted.

3. The carton of claim 1 further comprising: an inner top end wall panel foldably connected to each end edge of said inner top wall panel; an outer top end wall panel foldably connected to each end edge of said outer top wall panel; pairs of said inner and outer top end wall panels being lapped with each other and adhesively secured together; side end wall panels foldably connected to each side end edge of said side walls, and pairs of said side end wall panels being lapped and adhesively secured together with each lapped pair of said side end wall panels overlapping and being adhesively secured to an adjacent pair of said lapped inner and outer top end wall panels.

* * * * *